US006859632B2

(12) United States Patent
Dougherty

(10) Patent No.: US 6,859,632 B2
(45) **Date of Patent: *Feb. 22, 2005**

(54) SYSTEM FOR AND METHOD OF REMOVING OR PREVENTING ELECTROSTATIC CHARGES FROM AN ORGANIC PHOTOCONDUCTOR DURING TRANSIT

(75) Inventor: Patrick S. Dougherty, Bois, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/666,328

(22) Filed: Sep. 18, 2003

(65) Prior Publication Data

US 2004/0052546 A1 Mar. 18, 2004

Related U.S. Application Data

(63) Continuation of application No. 10/172,943, filed on Jun. 17, 2002, now Pat. No. 6,681,089.

(51) Int. Cl.[7] ..... G03G 21/18

(52) U.S. Cl. ..... 399/111; 399/114

(58) Field of Search ..... 399/103, 105, 399/111, 114, 116, 159; 206/53, 303, 389, 446

(56) References Cited

U.S. PATENT DOCUMENTS

| | | | | | |
|---|---|---|---|---|---|
| 4,598,993 | A | * | 7/1986 | Mizutani et al. | 399/111 |
| 4,860,898 | A | * | 8/1989 | Hiro et al. | 399/159 |
| 5,499,486 | A | * | 3/1996 | Kimoto et al. | 206/446 |
| 5,974,287 | A | * | 10/1999 | Kurz et al. | 399/114 |
| 6,317,573 | B1 | * | 11/2001 | Baker et al. | 399/114 |
| 6,336,017 | B1 | * | 1/2002 | Miyamoto et al. | 399/116 |
| 6,681,089 | B2 | * | 1/2004 | Dougherty | 399/111 |

* cited by examiner

*Primary Examiner*—William J. Royer

(57) ABSTRACT

The present invention includes a removable cover used to isolate a photoconductor drum from at least one other component in a toner cartridge. The photoconductor drum includes a cylinder coated with a photoconductive substance. Another embodiment includes a method of reducing electrostatic charges on the photoconductor drum including the steps of isolating the photoconductor drum from other components in a toner cartridge with a removable cover, removing the removable cover prior to insertion of the toner cartridge into an image device and inserting the toner cartridge into the image device.

24 Claims, 2 Drawing Sheets

SYSTEM FOR AND METHOD OF REMOVING OR PREVENTING ELECTROSTATIC CHARGES FROM AN ORGANIC PHOTOCONDUCTOR DURING TRANSIT

This application is a continuation of U.S. patent application Ser. No. 10/172,943 filed Jun. 17, 2002, now U.S. Pat. No. 6,681,084, entitled "SYSTEM FOR AND METHOD OF REMOVING OR PREVENTING ELECTROSTATIC CHARGES FROM AN ORGANIC PHOTOCONDUCTOR DURING TRANSMIT," the disclosure of which is hereby incorporated herein by reference.

FIELD OF INVENTION

The present invention is generally related to toner cartridges in imaging devices and specifically to the reduction or elimination of electrostatic charge buildup on toner cartridges during transit.

DESCRIPTION OF RELATED ART

Currently there are several types of technologies used in printing and copying systems. Electrophotographic printing devices such as laser printers and copiers use toner particles to form a desired image on a print medium, which is usually some type of paper. Once the toner particles are applied to the paper, the paper is advanced along a paper path to a fuser. In many printers, copiers and other electrophotographic printing devices, the fuser includes a heated fusing roller engaged by a mating pressure roller. As the paper passes between the rollers, the toner particles are fused to the paper through a process of heat and pressure.

FIG. 4 is a diagram of a typical laser printing device 400 employing an electrophotography (EP) process. For monochromatic printing, a single color of toner particles 401 (e.g., black) are held in a toner supply hopper 402. The toner particles 401 are typically small plastic (e.g., styrene) particles on the order of 5 microns ($10^{-6}$) meter in size. An agitator, or stirring blade, 403 is provided in the toner supply hopper 402 and is typically made of plastic or mylar and ensures toner particles 401 are uniformly positioned along a developer sleeve 404 while inducing a negative charge onto the toner particles 401 in the range of −30 to −40 micro coulomb per gram ($\mu c/g$). The developer sleeve 404 rotates in a counterclockwise direction about an internal stationary magnet 405 which acts as a shaft. The toner particles 401 are attracted to the rotating developer sleeve 404 by the magnetic forces of the stationary magnet 405. A doctor blade 406 helps in charging toner particles 401 and meters out a precise and uniform amount of toner particles 401 onto developer sleeve 404 as its outer surface rotates external to toner supply hopper 402. A developer sealing blade 407 removes excess toner particles 401 affixed to developer sleeve 404 as its outer surface rotates back into toner supply hopper 402.

A primary charging roller (PCR) 408 conditions an organic photoconductor (OPC) drum 409 using a constant flow of current to produce a blanket of uniform negative charge on the surface of OPC drum 409. Production of the uniform charge by PCR 408 also creates the effect of erasing residual charges left from a previous cycle.

A major component of the EP process is OPC drum 409. OPC drum 409 is a thin-walled aluminum cylinder coated with a photoconductive layer. The photoconductive layer may constitute a photodiode that accepts and holds a charge from PCR 408. Initially, the unexposed surface potential of the OPC drum 409 is approximately −600 volts. Typically, the photoconductive layer comprises three layers including, from the outermost inward, a charge transport layer (CTL), charge generation layer (CGL), and barrier or oxidizing layer formed on the underlying aluminum cylinder or substrate. The CTL is a clear layer approximately 20 microns thick, which allows light to pass through to the CGL and controls charge acceptance to the OPC drum 409. The CGL is about 0.1 to 1 micron thick and allows the flow of ions. The barrier layer bonds the photoconductive layer to the aluminum substrate.

A laser beam 410 exposes OPC drum 409 one line at a time at the precise locations that will receive toner particles 401 (paper locations which correspond to the image being printed). OPC drum 409 is discharged from −600V to approximately −100V at points of exposure to laser beam 410, creating a relatively positively charged latent image on its surface. Transformation of the latent image into a developed image begins when toner particles 401 are magnetically attracted to rotating developer sleeve 404. Alternatively, if nonmagnetic toner is used, developer sleeve 404 may comprise a foam roller to mechanically capture toner particles 401. In this case, an open cell foam roller may be included to apply toner to developer sleeve 404. The still negatively charged toner particles 401 held by developer sleeve 404 are attracted to the relatively positively charged areas of the surface of OPC drum 409 and "jump" across a small gap to the relatively positively charged latent image on OPC drum 409 creating a developed image.

Paper to receive toner particles 401 from OPC drum 409 is transported along paper path 411 between OPC drum 409 and transfer roller 412, with the developed image transferred from the surface of OPC drum 409 to the paper. The transfer occurs by action of transfer roller 412which applies a positive charge to the underside of the paper, attracting the negatively-charged toner particles 401 to move to the paper. A wiper blade 413 cleans the surface of the OPC drum 409 by scraping off the waste (untransferred) toner into waste hopper 415, while recovery blade 414 prevents the waste toner from falling back onto the paper. Fusing occurs as the paper, including toner particles 401, is passed through a nip region between heated roller 416 and pressure roller 417 where the toner particles 401 are melted and fused (or "bonded") to the paper. Heated roller 416 and pressure roller 417 are together referred to as a fuser assembly.

During shipping of a toner cartridge, internal parts such as OPC drum 409, PCR 408, transfer roller 412, and developer sleeve 404, may rub relative to each other thereby creating static charges. Large static charges may become trapped in the organic photoconductor (OPC) on OPC drum 409 and cause a defect in printer operations when the toner cartridge is positioned in an imaging device such as a printer or copier. This effect is called "plus charge memory" or "rubbed memory." Rubbed memory may be negative or positive. A negative charge trapped inside of the organic photoconductor (OPC) will create a repelling action leaving a portion of OPC drum 409 uncharged. Uncharged portions of OPC drum 409 may result in non-printed areas on a printed page.

During normal operation PCR 408 is arranged to uniformly charge the surface of OPC drum 409. However, the charge trapped during transit in the organic material of OPC drum 409 disrupts the constant charge field transferred from PCR 408. This causes a non-uniform charge across the surface of OPC drum 409 resulting in uneven print density and other defects on a printed page. Thus, to eliminate these printing defects it is necessary that a constant charge be applied to OPC drum 409 prior to modulation of the charge by a laser or projected image.

BRIEF SUMMARY OF THE INVENTION

The present invention is directed to a system which uses a removable cover to isolate an organic photoconductor from at least one other component of a toner cartridge. The present invention also includes a method of reducing electrostatic charge on a photoconductor including the steps of isolating the photoconductor from other components in a toner cartridge with a removable cover, removing the removable cover prior to insertion of the toner cartridge into an electrophotographic printing device and inserting the toner cartridge into the device.

DETAILED DESCRIPTION

Figure 1:
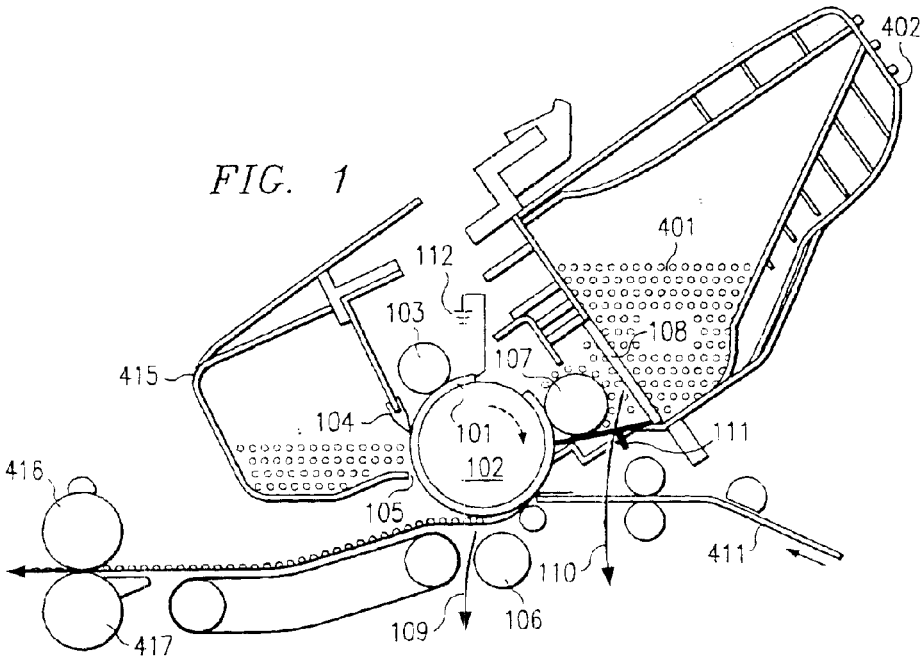
FIG. 1 is a side view of a simplified cartridge in cross-section with a removable cover according to the present invention in place.

During shipping and handling of toner cartridges, vibrations cause various components of a toner cartridge to rub against each other possibly resulting in a buildup of electrostatic charges. These electrostatic charges may become trapped inside or on a photoconductor roller such as OPC drum 102 (FIG. 1). The present invention prevents or eliminates these electrostatic charges by mechanically and electrically insulating the photoconductor roller from surrounding structures of the toner cartridge. The reduction or elimination of these charges prevents or reduces defects on printed materials resulting from the accumulation of these charges.

Extensive efforts have been directed to minimize the type and extent of rubbing between components with packaging design changes and boxes designed to reduce vibrations. The present invention isolates one of the components, preferably by enveloping that component in a packaging material preferably a resilient foam, or similar electrically isolating material, such as a thin film during shipping. This material is designed to be easily removed prior to or as part of inserting the toner cartridge into a printer.

This insulated packing layer may also be connected to an existing toner darn provided in toner cartridges. Removal of this toner darn is required to start the toner to flow into the developer area. Typically, a pull tab 111 (FIG. 1) is connected to the internal toner darn that must be removed before the toner cartridge is used in the printer. Similarly, a temporary protective removable cover (hereinafter simply a "removable cover") of the present invention must also be removed before the toner cartridge is inserted into the printer or at least prior to use of the toner cartridge should removal be possible after insertion and installation.

The removable cover preferably slides in-between the OPC drum 102 and any other component which may contact it. The present invention may further include an electrical connection 112 to a ground to drain charges which may build up on the removable cover. This may be accomplished by laminating conductive material, such as an aluminum film, to the removable cover.

The removable cover functions to reduce or eliminate high voltage electrostatic charges on the order of 250 or more volts. Voltages of this magnitude may be caught or trapped in the organic materials of the OPC drum 102. Used in combination with electrical drains included in the packaging and/or the chassis of the printer, the removable cover bleeds off most or all of this static charge to reduce or eliminate charges trapped in or on the OPC drum.

Referring to FIG. 1 a removable cover 101 is installed during assembly so as to almost completely encircle OPC drum 102, positioned between OPC drum 102 and one or more of the following components: primary charge roller (PCR) 103, cleaning blade 104, wiper blade 105, transfer roller 106, and developer roller 107. As its primary function, removable cover 101 isolates OPC 102 from these other components to reduce or eliminate the generation of static charges. Removable cover 101 may be made of a foam material such as polyurethane and may include a conductive laminate made of, for example, an aluminum film. The cushioning provided by the foam of removable cover 101 helps dampen vibration between the components. The removable cover 101 may also drain away to ground any remaining charge generated by components rubbing together if the conductive laminate is included. Thus, the conductive layer is grounded to packaging material so that any electrostatic charge drains off away from OPC drum 102 to ground.

The removable cover 101 may be connected to toner dam 108 by a tab 111 or other structure. During shipping, both removable cover 101 and toner dam 108 remain in place and are only removed immediately before the toner cartridge is installed into the printer or, after installation if the configuration permits. Removable cover 101 may be removed in a direction indicated by arrow 109 and toner dam 108 may be removed in a direction indicated by arrow 110. If the two are interconnected, as discussed above, removal of one will serve to remove the other.

Figure 2:
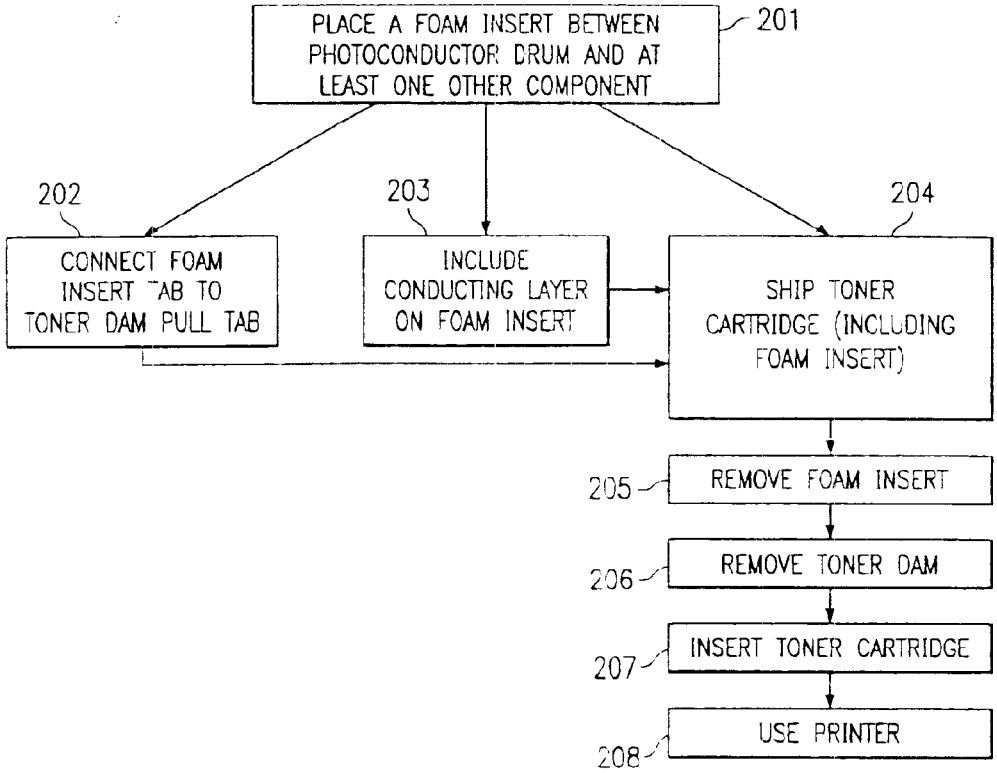
FIG. 2 shows a flow diagram of a method of reducing or eliminating plus charge memory.
Figure 4:
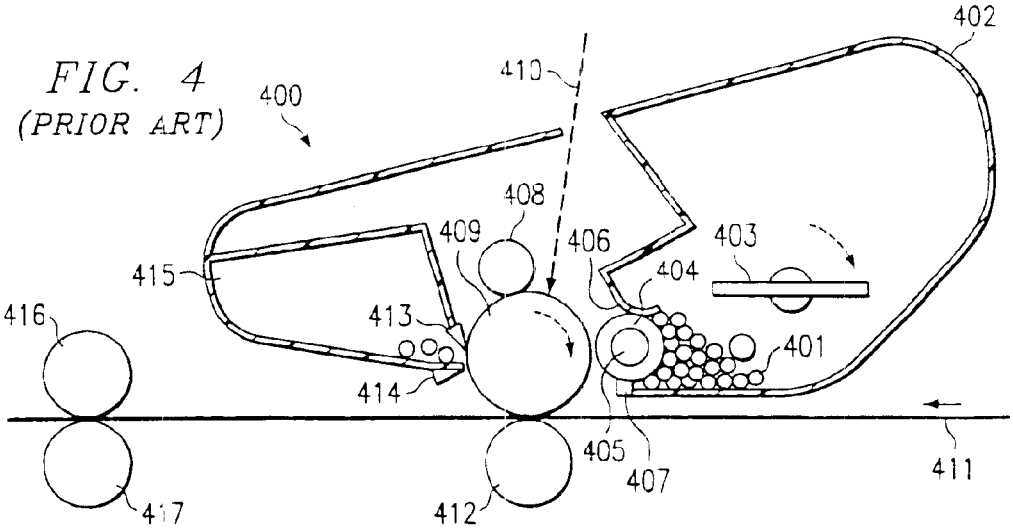
FIG. 4 (PRIOR ART)
FIG. 4 is a side view of a simplified cartridge cross-section of the prior art.

FIG. 2 is a diagram of a method of reducing or eliminating charge memory, a component of a printing system. In step 201 an insert, such as a foam insert, is placed between an organic photoconductor OPC drum 102 (FIG. 1) and at least one other system component which together with the OPC drum 102 may generate an electrostatic charge during shipment. In a preferred embodiment a removable cover 101 (FIG. 1) electrically isolates OPC drum 102 from all other system components. An insert tab may be included on the insert to assist in its removal. This insert tab may be connected to a pull tab preventing toner leakage during shipment or transit in step 201. The insert 101 may include a conductive layer 302 (FIG. 3) which is attached to ground in step 203. The toner cartridge is shipped in this protected shipping configuration in step 204. Before the toner cartridge is used, the insert 101 is removed in step 205 together with a toner dam 108 in step 206. If the insert 101 is connected to toner dam 108, these may be removed simultaneously. A single pull tab 111 may be connected to both toner dam 108 and insert 101 for ease of removal. In step 207 the toner cartridge is placed in the printer and the printer is operated in step 208.

Figure 3:
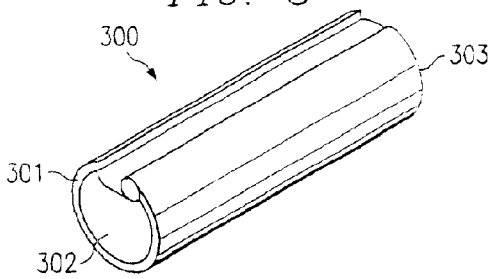
FIG. 3 is a perspective view of a cover for an OPC drum including a conductive layer according to an embodiment of the invention.

FIG. 3 shows one possible construction of an alternate embodiment of the removable cover 300 including a laminated construction. In this embodiment the inner foam characteristics of a first laminate 301 help absorb vibration and provide a physical barrier between components, and the conduction properties of a second laminate or conductive layer 302 act to drain to ground any built up static charges. Alternatively, removable cover 300 may be composed of a conductive laminate foam formed on both sides. End 303 of removable cover 300 slides into the toner cartridge.

Figure 5:
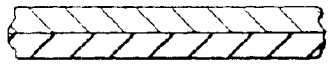
FIG. 5 is a cross-section of a cover material including a conductive layer.

FIG. 5 shows a cross section of a cover material including a conductive layer.

What is claimed is:

1. A toner cartridge comprising:

a photoconductor drum; and a removable cover attachable to said photoconductor drum wherein said removable cover isolates said photoconductor drum from at least one other component of said toner cartridge to reduce charges associated with said photoconductor drum.

2. The toner cartridge of claim 1 wherein said removable cover comprises a flexible, electrically isolating material.

3. The toner cartridge of claim 2 wherein said flexible, electrically isolating material is foam.

4. The toner cartridge of claim 1 wherein said removable cover comprises a non-conductive layer and a conductive layer.

5. The toner cartridge of claim 1 wherein said removable cover further comprises a tab for removal of said removable cover from said photoconductor drum.

6. The toner cartridge of claim 1 wherein said removable cover further includes a ground connection from said removable cover to a ground.

7. The toner cartridge of claim 1 further including at least one of a primary charge roller, cleaning blade, wiper blade, developer roller, and transfer roller.

8. The toner cartridge of claim 7 wherein said removable cover isolates said photoconductor drum from any included ones of said primary charge roller, cleaning blade, wiper blade, developer roller, and transfer roller.

9. The toner cartridge of claim 1 further comprising a development unit including:

a toner supply hopper for storing toner therein; and a toner dam removably secured to said toner supply hopper for temporarily sealing said toner supply hopper to prevent the discharge of the toner therefrom, said toner dam being adapted for removal by an operator.

10. The toner cartridge of claim 9 further comprising a connection between said toner dam and said removable cover which allows said toner dam and said removable cover to be removed at the same time.

11. The toner cartridge of claim 1 wherein said removable cover overlays at least fifty percent of an outer surface area of said photoconductor drum.

12. A method of reducing electrostatic charge on a selected component of a toner cartridge, said method including the steps of:

isolating said selected component from other components of said toner cartridge with a removable cover to bleed off static charge associated with said selected component; and removing said removable cover from said selected component prior to insertion of said toner cartridge into an image device.

13. The toner cartridge 12 wherein said selected component, is a photoconductor roller.

14. The method of claim 12 wherein the step of isolating further comprises the step of:

attaching a flexible, electrically isolating material to an exterior surface of said selected component.

15. The method of claim 12 wherein the step of isolating further comprises a step of:

attaching a removable cover including a non-conductive layer and a conductive layer to an exterior surface of said selected component.

16. The method of claim 12 further including the steps of:

mating said selected component to a development unit including a toner supply hopper for storing toner; and removably securing a toner dam to said toner supply hopper to prevent a discharge of the toner therefrom.

17. The method of claim 16 including the step of:

concurrently removing said toner dam and said removable cover.

18. A toner cartridge comprising:

a housing;

a development unit including a toner supply hopper and a developer roller;

a cleaning unit including a waste hopper, a wiper blade, and a cleaning blade;

a primary charge roller;

a transfer roller;

an organic photoconductor; and a removable cover wherein said removable cover isolates said organic photoconductor from at least one of said primary charge roller, cleaning blade, developer roller and transfer roller and bleeds off static charge associated with said organic photoconductor.

19. The toner cartridge of claim 18 wherein:

said removable cover comprises a film having an inner non-conductive layer and an outer conductive layer electrically connectable to a ground.

20. The toner cartridge of claim 18 wherein:

said removable cover is connected to a toner dam on said toner supply hopper.

21. A toner cartridge comprising:

a photoconductor drum;

a removable cover attachable to said photoconductor drum wherein said removable cover isolates said photoconductor drum from at least one other component of said toner cartridge to reduce charges associated with said photoconductor drum;

a toner dam removably secured to a toner supply hopper for temporarily sealing said toner supply hopper to prevent discharge of the toner therefrom, said toner dam being adapted for removal by an operator; and a tab connecting said removable cover to said toner dam which allows said removable cover and said toner dam to be removed at the same time.

22. The toner cartridge of claim 21 wherein said removable cover comprises a flexible, electrically isolating material.

23. The toner cartridge of claim 21 wherein said removable cover comprises a conductive laminate formed on both sides of said removable cover.

24. The toner cartridge of claim 21 wherein said removable cover comprises:

a first conductive laminate, wherein said first conductive laminate absorbs vibrations and provides a physical barrier between said photoconductor drum and said at least one other component; and a second conductive laminate, wherein said second conductive laminate drains to a ground static charges that develop on said removable cover.

* * * * *